US008443535B2

(12) United States Patent
Liu et al.

(10) Patent No.: US 8,443,535 B2
(45) Date of Patent: May 21, 2013

(54) EMERGENCY EXIT INDICATOR

(75) Inventors: Tay-Jian Liu, Taipei Hsien (TW); Ying Xiong, Shenzhen (CN); Jian-Bing Qian, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 188 days.

(21) Appl. No.: 12/868,682

(22) Filed: Aug. 25, 2010

(65) Prior Publication Data

US 2011/0138665 A1 Jun. 16, 2011

(30) Foreign Application Priority Data

Dec. 16, 2009 (CN) ..... 2009 1 0311653

(51) Int. Cl.
*G09F 13/18* (2006.01)
*G09F 13/04* (2006.01)
*A47G 1/10* (2006.01)

(52) U.S. Cl.
USPC ..... 40/570; 40/782; 40/546

(58) Field of Classification Search
USPC ..... 40/570, 782, 546
See application file for complete search history.

(56) References Cited

U.S. PATENT DOCUMENTS

| | | | | |
|---|---|---|---|---|
| 3,811,214 | A * | 5/1974 | Tate | 40/782 |
| 4,630,386 | A * | 12/1986 | Wilson | 40/734 |
| 4,811,179 | A * | 3/1989 | Komatsu et al. | 362/256 |
| 4,833,803 | A * | 5/1989 | Schwartz | 40/783 |
| 5,463,973 | A * | 11/1995 | Tait | 116/173 |
| 5,950,340 | A * | 9/1999 | Woo | 40/564 |
| 6,294,983 | B1 * | 9/2001 | Lee | 340/332 |
| 6,481,130 | B1 * | 11/2002 | Wu | 40/546 |
| 2008/0263923 | A1 * | 10/2008 | Kim | 40/550 |

* cited by examiner

*Primary Examiner* — Joanne Silbermann
*Assistant Examiner* — Syed A Islam
(74) *Attorney, Agent, or Firm* — Altis Law Group, Inc.

(57) ABSTRACT

An emergency exit indicator includes a housing and a light source received in the housing. The housing includes two first connecting arms at top and bottom thereof and two second connecting arms at lateral sides thereof. The first and second connecting arms are connected with each other by four connecting units located respectively at four corners of the housing. Each connecting unit includes a seat and two engaging tabs extending from the seat. One engaging tab is engaged with a corresponding first connecting arm, and the other is engaged with a neighboring second connecting arm.

16 Claims, 5 Drawing Sheets

EMERGENCY EXIT INDICATOR

BACKGROUND

1. Technical Field

The disclosure generally relates to a lighting apparatus, and more particularly, to an emergency exit indicator.

2. Description of Related Art

Provision of emergency exits in commercial buildings is required by law. The signs that mark emergency exits are typically used in the case of power failures (blackout), fires, and other emergency situations. An emergency exit indicator is required as a standard equipment for public facilities, such as shopping malls or airplanes. Numerous different types of emergency exit indicators exist in the art including those that use lights to guide people in the direction of an emergency exit door. When the condition requires, the emergency exit indicator is able to indicate the location of an emergency escape exit for people so as to assist people evacuation.

LEDs have been increasingly used in a variety of occasions, such as residential, traffic, commercial, and industrial occasions due to their high light-emitting efficiency. Related emergency exit indicator generally includes an integrally formed housing and a plurality of parts such as LEDs, electrical module, front and back panels, etc. arranged in the housing. The multiple LEDs are arranged along a side of a cover of the housing so that the light emitting from the LEDs could radiate through symbols, letters or patterns on the cover to make the symbols, letters or patterns shine or glitter. However, the integrally formed housing and the inconsistently positioned techniques for the parts cannot be applied to emergency exit indicators of different sizes. Therefore, different molds and position techniques are required to manufacture the emergency exit indicators of different sizes, which results in a complicated manufacturing process and a high manufacturing cost. Furthermore, the light emitting from the LEDs is highly directive that the symbols, letters or patterns on the cover cannot be uniformly illuminated, and the light-utilizing efficiency of the indicating lamp is accordingly limited.

What is needed, therefore, is an emergency exit indicator incorporating LEDs which can overcome the limitations described above.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
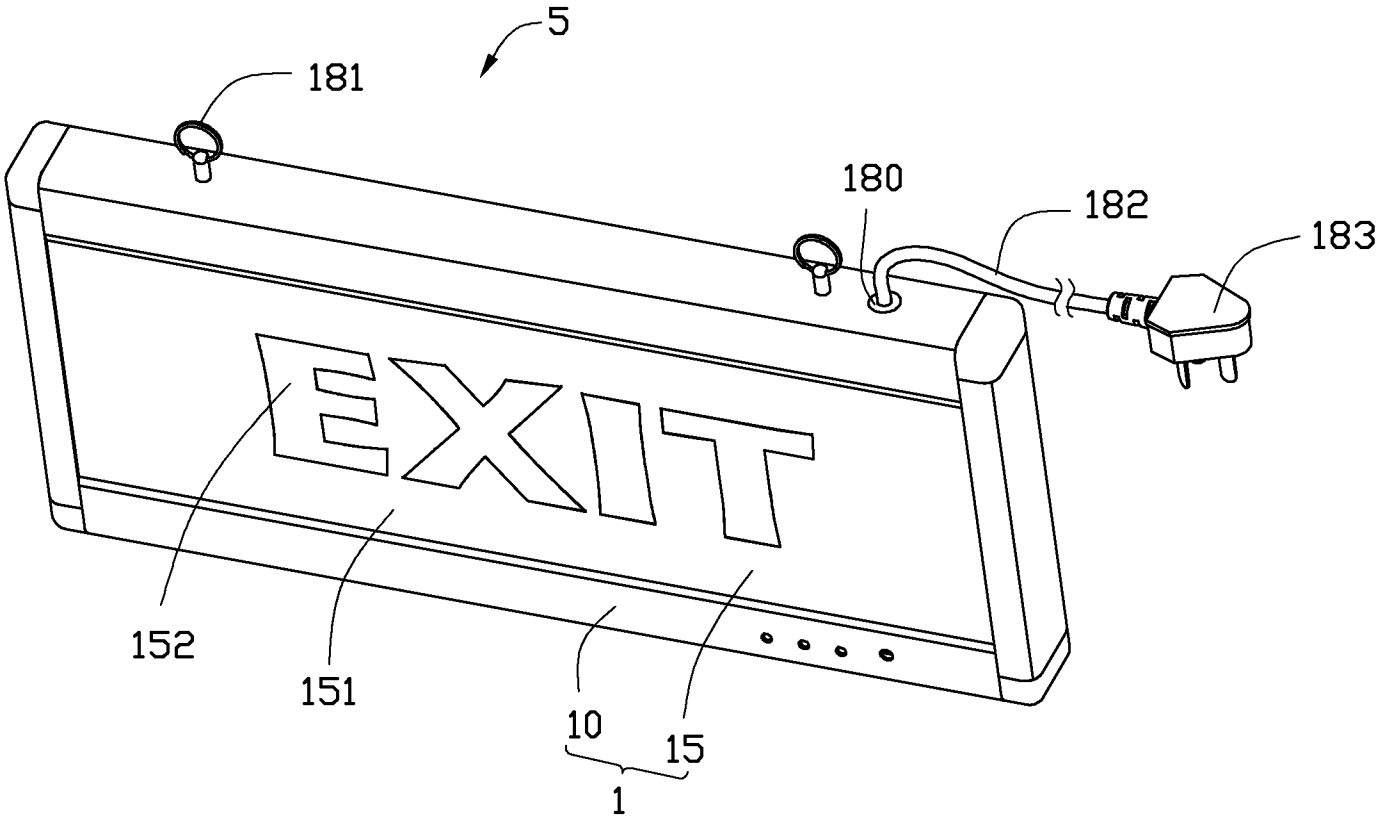
FIG. 1 is an isometric view of an emergency exit indicator according to one embodiment of the disclosure.
Figure 2:
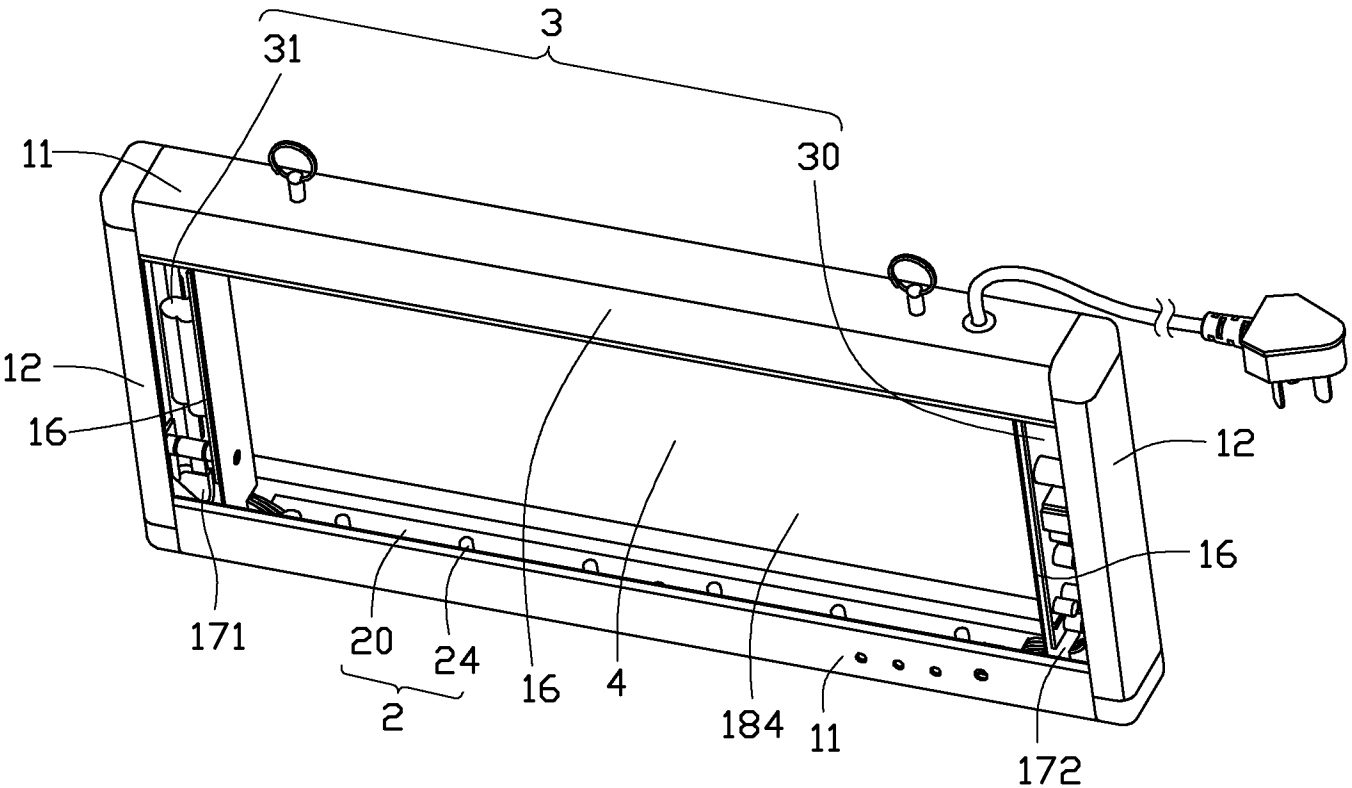
FIG. 2 is similar to FIG. 1, but with a front panel of the emergency exit indicator being removed.

Referring to FIGS. 1 and 2, an emergency exit indicator 5 according to an embodiment of the disclosure is illustrated.

The emergency exit indicator 5 includes a housing 1, a light source 2, and an electrical module 3. The electrical module 3 and the light source 2 are received in the housing 1.

The housing 1 is flat and rectangular, with a length much greater than a thickness thereof. The housing 1 includes a frame 10, a front panel 15 coupled to a front side of the frame 10, and a back plate 184 coupled to a rear side of the frame 10. The front panel 15 is provided with a sign 152 thereon, wherein the sign 152 may be symbols, letters or patterns that can be used to mark emergency exits. People can see the sign 152 when the sign 152 is illuminated by the light source 2. Other portions of the front panel 15 surrounding the sign 152 is light non-penetrable to form a non-display area 151.

The light source 2 is located at a bottom side in the housing 1. Three spacing plates 16 are provided in the housing 1. The three spacing plates 16 are arranged adjacent to the three other sides (i.e., left side, right side and top side) of the housing 1, respectively. An elongated space 171 is defined between the frame 10 and the left-side spacing plate 16 for receiving a rechargeable battery 31 of the electrical module 3 therein. An elongated space 172 is defined between the frame 10 and the right-side spacing plate 16 for receiving a circuit board 30 of the electrical module 3 therein. An elongated space 173 (FIG. 3) is defined between the frame 10 and the top-side spacing plate 16 for receiving power lines 182 therein, wherein the power lines 182 extend out of the housing 1 through a wire hole 180 defined at the top side of the housing 1 for electrically connecting the circuit board 30 with an external alternating current (AC) power source (not shown) by a plug 183.

The light source 2 includes a substrate 20, a plurality of LEDs 21 mounted on the substrate 20, and a plurality of light guide devices 24 each covered on a corresponding LED 21. The substrate 20 may be a metal core printed circuit board (MCPCB), a ceramic printed circuit board (CPCB) or other suitable circuit boards having good heat-conducting capabilities. The LEDs 21 are evenly arranged on the substrate 20 and spaced from each other. A flat light distribution space 4 is defined between the front panel 15 and the back plate 184 and surrounded by the substrate 20 and the three spacing plates 16. The light emitting from the LEDs 21 of the light source 2 enters and is mixed in the light distribution space 4. After the light is mixed in the light distribution space 4, the light then illuminates uniformly on the sign 152 of the front panel 15 to cause the sign 152 to be visible noticeably. In order to more evenly reflect the light in the light distribution space 4 towards the sign 152, an inner surface of each spacing plate 16, an inner surface of the non-display area 151 of the front panel 15, and an inner surface of the back plate 184 may be coated with a light reflecting material.

Figure 3:
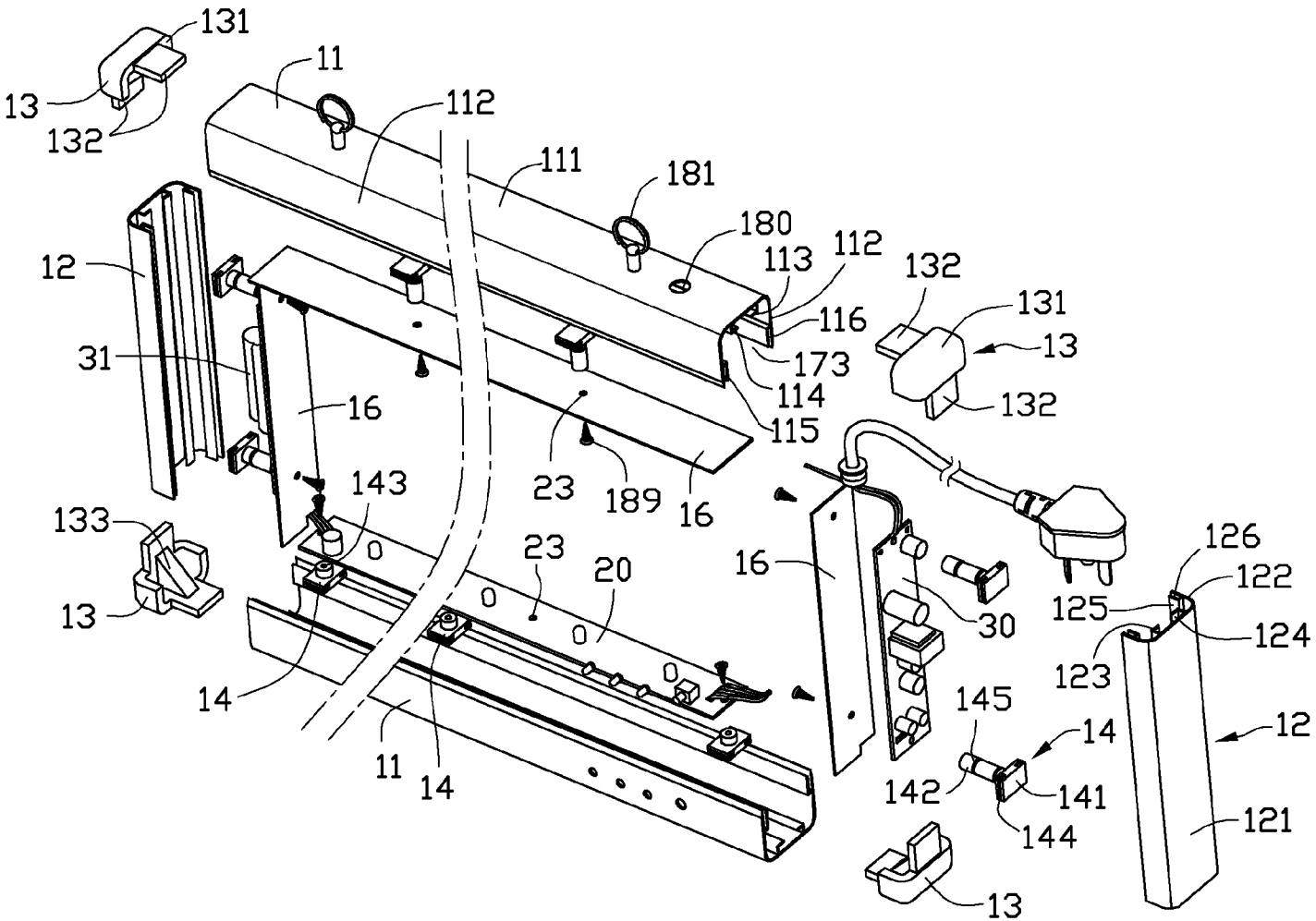
FIG. 3 is an exploded view of the emergency exit indicator of FIG. 2, with a back plate thereof being further removed.

Referring also to FIG. 3, the frame 10 includes two first connecting arms 11 at top and bottom sides thereof, and two second connecting arms 12 at left and right sides thereof. The first connecting arms 11 are perpendicular to the second connecting arms 12. The four connecting arms 11, 12 are connected with each other by four connecting units 13 to form the frame 10, wherein the four connecting units 13 are located respectively at four corners of the frame 10, with each connecting unit 13 connecting one of the two first connecting arms 11 with a neighboring one of the two second connecting arms 12. Each connecting unit 13 includes a seat 131 and two engaging tabs 132 extending from the seat 131. The two engaging tabs 132 are perpendicular to each other, wherein one of the two engaging tabs 132 is parallel to the first connecting arm 11, and the other one of the two engaging tabs 132 is parallel to the second connecting arm 12. An enforcing rib 133 is located at an inner side of the seat 131 and connected between the two engaging tabs 132 to reinforce the connecting unit 13.

Each of the first and second connecting arms 11, 12 is U-shaped, and includes a base plate 111, 121 and a pair of side plates 112, 122 extending perpendicularly from two opposite lateral sides of the base plate 111, 121 respectively. A pair of L-shaped guiding rails 113, 123 is provided respectively at an inner surface of the base plate 111, 121 and extends towards an interior of the housing 1. The two guiding rails 113, 123 face each other, with a guiding slot 114, 124 being defined respectively between the base plate 111, 121 and the guiding rails 113, 123. An L-shaped locking plate 115, 125 is provided respectively at an inner surface of each side plate 112, 122 adjacent to a distal side edge thereof which is located away from the base plate 111, 121. A locking slot 116, 126 is defined respectively between the side plate 112, 122 and the locking plate 115, 125 for receiving a side edge of the front panel 15 (or the back plate 184).

In order to mount the three spacing plates 16 and the substrate 20 to the frame 10, a plurality of supporting units 14 are provided in the housing 1. Each supporting unit 14 includes a base 141 and a pole 142 extending perpendicularly from the base 141. A sliding slot 144 is defined in each of two opposite lateral sides of the base 141. A plurality of annular grooves 145 are defined around an outer surface of the pole 142 and spaced evenly from each other along a lengthwise direction of the pole 142, such that the pole 142 is divided into multiple sections by the annular grooves 145, and one or more top section(s) of the pole 142 can be cut away from one of the annular grooves 145 to easily adjust a length of the pole 142. A thread hole 143 is defined in the pole 142 along the lengthwise direction of the pole 142.

During assembly, the two sliding slots 144 of each of the supporting units 14 are aligned with the two guiding rails 113, 123 of each of the first and second connecting arms 11, 12, respectively. The sliding slots 113, 123 are capable of sliding along the guiding rails, respectively, such that the supporting units 14 are mounted to the first and second connecting arms 11, 12. A screw 189 is provided to extend through a mounting hole 23 defined in each spacing plate 16 and the substrate 20, and then to threadedly engage in the thread hole 143 of the supporting unit 14, to thereby mount the spacing plates 16 and the substrate 20 to the first and second connecting arms 11, 12 of the frame 10. Since the pole 142 is composed of multiple sections by the annular grooves 145, a size of each space 171, 172 (FIG. 2), 173 (FIG. 3) between the base plate 111, 121 of the first and second connecting arms 11, 12 and the spacing plates 16 (or the substrate 20) can be easily adjusted by cutting away excessive section(s) of the pole 142 of each supporting unit 14.

Four side edges of each of the front panel 15 and the back plate 184 are inserted into the locking slots 116, 126 of the locking plates 115, 125 of the first and second connecting arms 11, 12, to thereby mount the front panel 15 and the back plate 184 at the front side and the back side of the frame 10, respectively. One of the two engaging tabs 132 of each connecting unit 13 is inserted and engaged in an end of the guiding slots 114 of the first connecting arm 11, and the other one of the two engaging tabs 132 of each connecting unit 13 is inserted and engaged in an end of the guiding slots 124 of the second connecting arm 12, such that the first and second connecting arms 11, 12 are connected with each other by the connecting units 13. In the embodiment, the frame 10 of the housing 1 is assembled together by the first and second connecting arms 11, 12 through the connecting units 13. Thus, the frame 10 can be easily designed to be applied to emergency exit indicators of different sizes. A relatively small number of molds are only required to manufacture the housings and position the parts of the emergency exit indicators of different sizes, to thereby avoid a complicated manufacturing process and a high manufacturing cost.

The rechargeable battery 31 and the circuit board 30 of the electrical module 3 are electrically connected with the substrate 20 of the light source 2. Several circuits are formed on the circuit board 30. Such circuits may include AC to direct current (DC) conversion circuit, battery charging circuit, and control circuit. In operation, the external AC power source is electrically connected with the circuit board 30 by the power lines 182. The AC to DC conversion circuit of the circuit board 30 converts the AC power provided by the external AC power source into DC power. When the external AC power source is supplied normally, the DC power converted from the external AC power source is supplied to the light source 2 and the rechargeable battery 31. As a result, the light source 2 is turned on to emit light, and at the same time, the rechargeable battery 31 is charged via charging control by the battery charging circuit of the circuit board 30.

When the external AC power source supply is interrupted, the external AC power source can no longer supply power to the light source 2. At this time, the control circuit of the circuit board 30 controls the light source 2 to automatically enter in a state in which the rechargeable battery 31 begins to supply DC current to the light source 2 to cause the light source 2 to emit light, such that the light source 2 can emit light in an uninterrupted manner.

Figure 4:
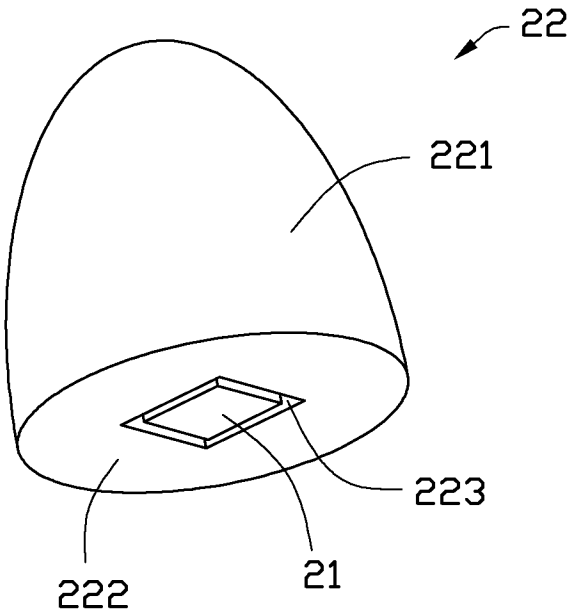
FIG. 4 is an isometric view of a light guide device for a light source of the emergency exit indicator of FIG. 2.

Referring to FIG. 4, the light guide device 24 is a lens 22 in the first embodiment. The lens 22 is made of transparent materials such as PC (polycarbonate) or PMMA (polymethylmethacrylate). The lens 22 includes a flat bottom surface 222 and an outer surface 221 around the lens 22. The lens 22 is formed by cutting out a bottom portion of an ellipsoid. Thus, the lens 22 is in the form of a truncated ellipsoid. The bottom surface 222 has the shape of an ellipse, and the outer surface 221 has the shape of an ellipsoid. A major axis of the bottom surface 222 is located along a lengthwise direction of the housing 1, and a minor axis of the bottom surface 222 is located along a thickness direction of the housing 1. The bottom surface 222 has a center at which the LED 21 is located. A rectangular receiving groove 223 is defined in the bottom surface 222 of the lens 22 for receiving the LED 21 therein.

The outer surface 221 of the lens 22 forms as a curved light-emergent surface through which the light within the lens 22 is refracted out of the lens 22. After the light of the LED 21 is refracted by the outer surface 221, the light is upwardly converged by the lens 22. Since the lens 22 has the shape like an ellipsoid, the lens 22 has two opposite sides along the lengthwise direction of the housing 1 longer than the other two opposite sides along the thickness direction of the housing 1, such that a curvature of the outer surface 221 along the thickness direction of the housing 1 is greater than a curvature of the outer surface 221 along the lengthwise direction of the housing 1. The light throughout the outer surface 221 of the lens 22 along the thickness direction of the housing 1 is upwardly converged in a narrower manner than the light throughout the outer surface 221 of the lens 22 along the lengthwise direction of the housing 1.

Due to the presence of the lens 22 as the light guide device, the light from the LEDs 21 can enter the light distribution space 4 of the housing 1 effectively and uniformly. Particularly, the light refracted out from the outer surface 221 of the lens 22 along the thickness direction of the housing 1 is converged within a relatively narrower region than the light refracted out from the outer surface 221 of the lens 22 along the lengthwise direction of the housing 1. The light from all of the LEDs 21 is effectively radiated into and mixed uniformly in the light distribution space 4 of the housing 1, and then the mixed light is projected on the sign 152 to cause the sign 152 to be illuminated and visible. Thus, the light-utilizing efficiency of the light source 2 is accordingly increased.

Figure 5:
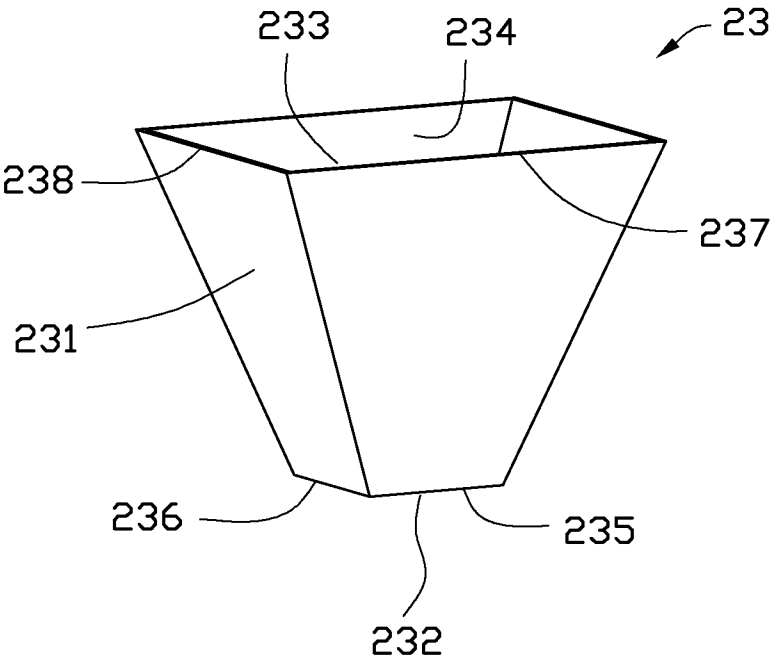
FIG. 5 is an isometric view of a light guide device for the light source according to an alternative embodiment.

FIG. 5 shows the light guide device 24 according to an alternative embodiment. In the alternative embodiment, the light guide device 24 is a light guide cup 23. The light guide cup 23 includes four side plates 231 connected with each other to form the light guide cup 23. An inner surface of each side plate 231 is formed as a light reflecting surface 234. The light guide cup 23 is hollow and defined with a top opening 233 and a bottom opening 232 at top and bottom sides thereof, respectively. The light guide cup 23 is tapered along a top-to-bottom direction, such that the top opening 233 has a size greater than the bottom opening 232. The top opening 233 is rectangular, with two parallel long sides 237 and two parallel short sides 238 interconnecting the long sides 237. The bottom opening 232 is also rectangular, with two parallel long sides 235 and two parallel short sides 236 interconnecting the long sides 235. Each of the long sides 237, 235 is arranged along the lengthwise direction of the housing 1, and each of short sides 238, 236 is arranged along the thickness direction of the housing 1. The LED 21 is located at the center of the bottom opening 232. The light of the LED 21 is reflected by the light reflecting surfaces 234 of the side plates 231 and enters the light distribution space 4 through the top opening 233. The light throughout the top opening 233 of the light guide cup 23 along the thickness direction of the housing 1 is upwardly converged in a narrower manner than the light throughout the top opening 233 of the light guide cup 23 along the lengthwise direction of the housing 1. Thus, the light from the LED 21 is effectively radiated into and mixed uniformly in the light distribution space 4 of the housing 1 by the light guide cup 23 as the light guide device.

It is believed that the disclosure and its advantages will be understood from the foregoing description, and it will be apparent that various changes may be made thereto without departing from the spirit and scope of the disclosure or sacrificing all of its material advantages, the examples hereinbefore described merely being preferred or exemplary embodiments.

What is claimed is:

1. An emergency exit indicator, comprising:

a housing comprising two first connecting arms at top and bottom sides thereof and two second connecting arms at left and right sides thereof, the first and second connecting arms being connected with each other by four connecting units, the four connecting units being located respectively at four corners of the housing, each connecting unit comprising a seat and two engaging tabs extending from the seat, one of the two engaging tabs being engaged with a corresponding first connecting arm, the other one of the two engaging tabs being engaged with a neighboring second connecting arm; and a light source received in the housing;

wherein the seats of the four connecting units are exposed out of the two first connecting arms and the two second connecting arms, and the seats, the two first connecting arms and the two second connecting arms cooperatively form a periphery of the housing;

wherein the housing is flat and rectangular, with a length much greater than a thickness thereof;

wherein the light source comprises a substrate, a plurality of LEDs mounted on the substrate, and a light guide device coupled to each of the LEDs, the light through the light guide device along a thickness direction of the housing being converged in a narrower manner than the light through the light guide device along a lengthwise direction of the housing; and wherein the light guide device is in the form of a hollow light guide cup with a top opening and a bottom opening at top and bottom sides thereof, respectively, the light guide cup being tapered along a top-to-bottom direction, the top opening having a size greater than the bottom opening, one of the LEDs being located at the center of the bottom opening.

2. The emergency exit indicator of claim 1, wherein a pair of guiding rails is provided at each of the first and second connecting arms and extends towards an interior of the housing, the two guiding rails facing each other with a guiding slot being defined therebetween.

3. The emergency exit indicator of claim 2, wherein the one of the two engaging tabs is inserted and engaged in the guiding slot of the corresponding first connecting arm, the other one of the two engaging tabs being inserted and engaged in the guiding slot of the neighboring second connecting arm.

4. The emergency exit indicator of claim 2, wherein a plurality of supporting units are provided to be movably mounted on the guiding rails, each of the supporting units comprising a base and a pole extending from the base, two sliding slots being defined in two opposite lateral sides of the base, respectively, the sliding slots being capable of sliding along the guiding rails, respectively.

5. The emergency exit indicator of claim 4, wherein the light source comprises a substrate and a plurality of LEDs mounted on the substrate, the substrate being mounted on the poles of the supporting units.

6. The emergency exit indicator of claim 4, wherein a circuit board is provided in the housing, the light source being electrically connected with the circuit board, the circuit board being mounted on the poles of the supporting units.

7. The emergency exit indicator of claim 4, wherein a spacing plate and a rechargeable battery are provided in the housing, the rechargeable battery electrically connecting with the light source, being received in an elongated space between the spacing plate and the second connecting arm, and the spacing plate being mounted on the poles of the supporting units.

8. The emergency exit indicator of claim 4, wherein a plurality of annular grooves are defined around an outer surface of the pole such that the pole is divided into multiple sections by the annular grooves, and one or more top section (s) of the pole can be cut away from one of the annular grooves to adjust a length of the pole.

9. The emergency exit indicator of claim 1, wherein each connecting unit further comprises an enforcing rib connected between the two engaging tabs.

10. The emergency exit indicator of claim 1, wherein each of the top and bottom openings is rectangular with two long sides and two short sides interconnecting the long sides, each of the long sides being located along the lengthwise direction of the housing, each of short sides being located along the thickness direction of the housing.

11. The emergency exit indicator of claim 1, wherein the light guide cup comprises four side plates connected with each other to form the light guide cup, an inner surface of each of the side plates being formed as a light reflecting surface, the light of the LED being reflected by the light reflecting surfaces of the side plates and entering the housing through the top opening.

12. The emergency exit indicator of claim 1, wherein the housing is flat, and further comprises a front panel coupled to a front side of the housing, and a back plate coupled to a rear side of the housing, a sign being provided on one of the front panel and the rear plate to mark emergency exits, the first and second connecting arms surrounding the front panel and the rear plate, a flat light distribution space being defined between the front panel and the rear plate, the light source being disposed in the light distribution space.

13. The emergency exit indicator of claim 12, wherein each of the first and second connecting arms comprises a base plate and a pair of side plates extending from two opposite lateral sides of the base plate, respectively.

14. The emergency exit indicator of claim 13, wherein an L-shaped locking plate is provided at an inner surface of each of the side plates, a locking slot being defined between each side plate and a corresponding locking plate, four side edges of each of the front panel and the back plate being inserted into the locking slots of the first and second connecting arms to mount the front panel and the back plate at the front side and the back side of the housing, respectively.

15. An emergency exit indicator, comprising:

a housing comprising two first connecting arms at top and bottom sides thereof and two second connecting arms at left and right sides thereof, the first and second connecting arms being connected with each other by four connecting units, the four connecting units being located respectively at four corners of the housing, each connecting unit comprising a seat and two engaging tabs extending from the seat, one of the two engaging tabs being engaged with a corresponding first connecting arm, the other one of the two engaging tabs being engaged with a neighboring second connecting arm; and a light source received in the housing;

wherein the seats of the four connecting units are exposed out of the two first connecting arms and the two second connecting arms, and the seats, the two first connecting arms and the two second connecting arms cooperatively form a periphery of the housing;

wherein the housing is flat and rectangular, with a length much greater than a thickness thereof;

wherein the light source comprises a substrate, a plurality of LEDs mounted on the substrate, and a light guide device coupled to each of the LEDs, the light through the light guide device along a thickness direction of the housing being converged in a narrower manner than the light through the light guide device along a lengthwise direction of the housing;

wherein the light guide device is in the form of a lens, the lens being formed by cutting out a bottom portion of an ellipsoid such that the lens comprises a flat bottom surface and an outer surface around the lens, the light of the LED being refracted out of the lens through the outer surface, the outer surface of the lens having the shape of an ellipsoid, the bottom surface having the shape of an ellipse, a major axis of the bottom surface being located along the lengthwise direction of the housing, a minor axis of the bottom surface being located along the thickness direction of the housing; and wherein the bottom surface of the lens defines a receiving groove for receiving a corresponding LED therein.

16. An emergency exit indicator, comprising:

a housing comprising two first connecting arms at top and bottom sides thereof and two second connecting arms at left and right sides thereof, the first and second connecting arms being connected with each other by four connecting units, the four connecting units being located respectively at four corners of the housing, each connecting unit comprising a seat and two engaging tabs extending from the seat, one of the two engaging tabs being engaged with a corresponding first connecting arm, the other one of the two engaging tabs being engaged with a neighboring second connecting arm; and a light source received in the housing;

wherein the seats of the four connecting units are exposed out of the two first connecting arms and the two second connecting arms, and the seats, the two first connecting arms and the two second connecting arms cooperatively form a periphery of the housing;

wherein the housing is flat and rectangular, with a length much greater than a thickness thereof;

wherein the light source comprises a substrate, a plurality of LEDs mounted on the substrate, and a light guide device coupled to each of the LEDs, the light through the light guide device along a thickness direction of the housing being converged in a narrower manner than the light through the light guide device along a lengthwise direction of the housing;

wherein a pair of guiding rails is provided at each of the first and second connecting arms and extends towards an interior of the housing, the two guiding rails facing each other with a guiding slot being defined therebetween;

wherein a plurality of supporting units are provided to be movably mounted on the guiding rails, each of the supporting units comprising a base and a pole extending from the base, two sliding slots being defined in two opposite lateral sides of the base, respectively, the sliding slots being capable of sliding along the guiding rails, respectively; and wherein a plurality of annular grooves are defined around an outer surface of the pole such that the pole is divided into multiple sections by the annular grooves, and one or more top section(s) of the pole can be cut away from one of the annular grooves to adjust a length of the pole.

* * * * *